US009839331B2

(12) United States Patent
Sinclair, Jr.

(10) Patent No.: US 9,839,331 B2
(45) Date of Patent: Dec. 12, 2017

(54) INTERGLUTEAL CLEFT CLEANING DEVICE

(71) Applicant: Robert Curtis Sinclair, Jr., LaBelle, FL (US)

(72) Inventor: Robert Curtis Sinclair, Jr., LaBelle, FL (US)

( * ) Notice: Subject to any disclaimer, the term of this patent is extended or adjusted under 35 U.S.C. 154(b) by 0 days.

(21) Appl. No.: 15/198,082

(22) Filed: Jun. 30, 2016

(65) Prior Publication Data

US 2017/0055783 A1 Mar. 2, 2017

Related U.S. Application Data

(60) Provisional application No. 62/210,196, filed on Aug. 26, 2015.

(51) Int. Cl.

| | |
|---|---|
| ***A47K 7/02*** | (2006.01) |
| ***A46B 5/02*** | (2006.01) |
| ***A47K 7/08*** | (2006.01) |

(52) U.S. Cl.

CPC ..... *A47K 7/02* (2013.01); *A46B 5/025* (2013.01); *A46B 5/026* (2013.01); *A47K 7/08* (2013.01); *A46B 2200/1006* (2013.01)

(58) Field of Classification Search

CPC ..... A47K 7/02; A46B 5/025; A46B 5/026

See application file for complete search history.

(56) References Cited

U.S. PATENT DOCUMENTS 2,491,274 A * 12/1949 McNeill ..... A61B 17/244 15/244.1

2008/0131842 A1* 6/2008 Edwards ..... A46B 5/02 433/215

* cited by examiner

*Primary Examiner* — Shay Karls

(74) *Attorney, Agent, or Firm* — Dunlap Bennett & Ludwig PLLC

(57) ABSTRACT

A cleaning device is provided. The cleaning device includes a brush member and a handle. The brush member extends from the handle. The brush member includes a first side, a second side opposite the first side, a first edge and a second edge opposite the first edge. A distance between the first edge and the second edge is substantially greater than a distance between the first side and the second side. Therefore, the brush member may have a thin profile and resemble a blade. A plurality of bristles extend from at least the first side, the second side and one of the first edge and the second edge of the brush member.

8 Claims, 2 Drawing Sheets

INTERGLUTEAL CLEFT CLEANING DEVICE

CROSS-REFERENCE TO RELATED APPLICATION

This application claims the benefit of priority of U.S. provisional application No. 62/210,196, filed Aug. 26, 2015, the contents of which are herein incorporated by reference.

BACKGROUND OF THE INVENTION

The present invention relates to a brush and, more particularly, to an intergluteal cleft cleaning device.

Currently, it is difficult to properly clean hard to reach areas, such as in between the intergluteal cleft.

As can be seen, there is a need for a device that properly cleans in between the intergluteal cleft.

SUMMARY OF THE INVENTION

In one aspect of the present invention, a cleaning device comprises: a handle; a brush member extending from the handle and comprising a first side, a second side opposite the first side, a first edge and a second edge opposite the first edge, wherein a distance between the first edge and the second edge is substantially greater than a distance between the first side and the second side; and a plurality of bristles extending from at least the first side, the second side and one of the first edge and the second edge.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a brush used to clean and sanitize the hard to reach intergluteal cleft with soap and water. The present invention is used to reduce itching, odor and rashes. The present invention is easy to use and control because of a special handle designed to quickly and easily wash the whole gluteus and rectal area in the comfort of your own bath.

Figure 1:
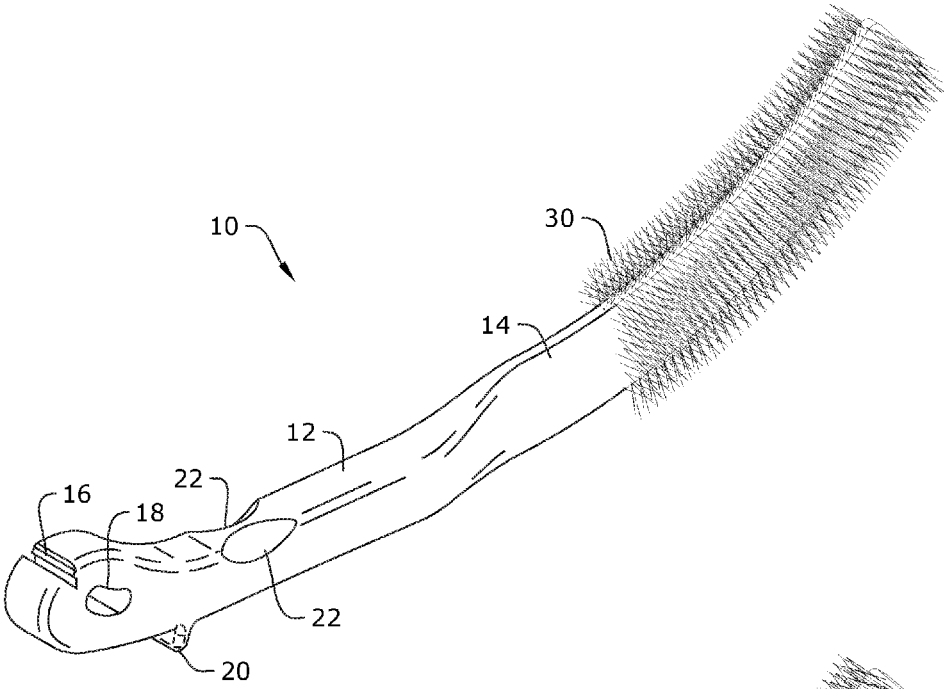
FIG. 1 is a perspective view of an embodiment of the present invention.
Figure 2:
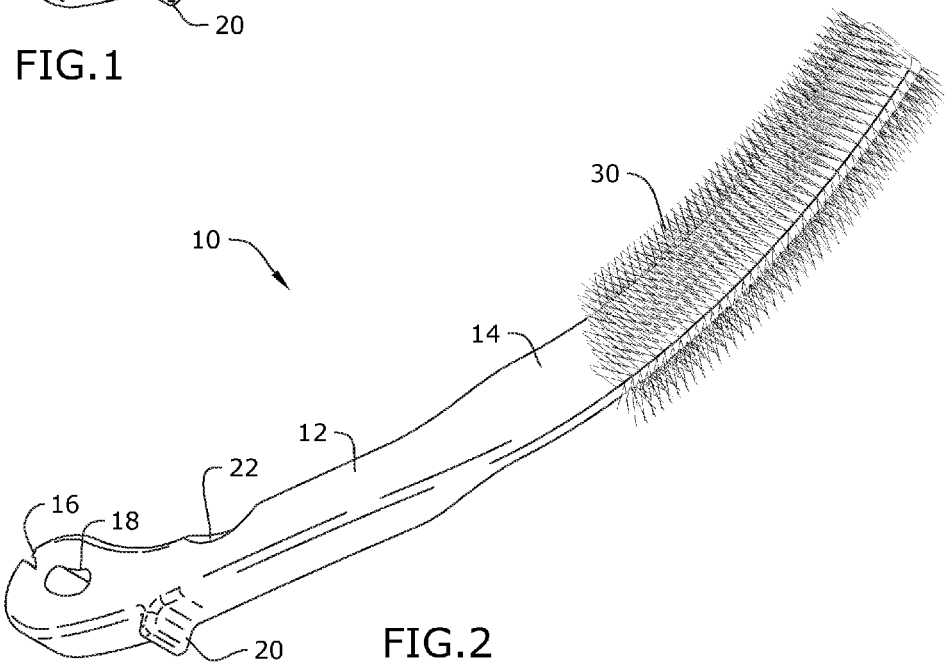
FIG. 2 is a reverse perspective view of an embodiment of the present invention.
Figure 3:
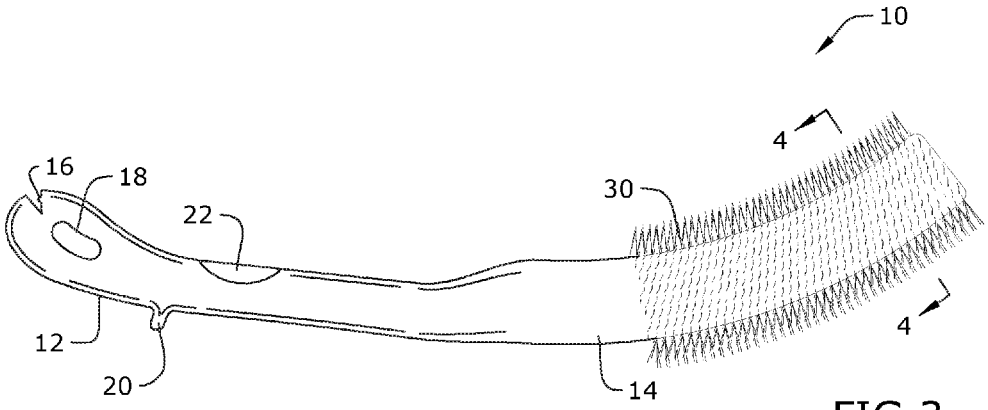
FIG. 3 is a side view of an embodiment of the present invention.
Figure 4:
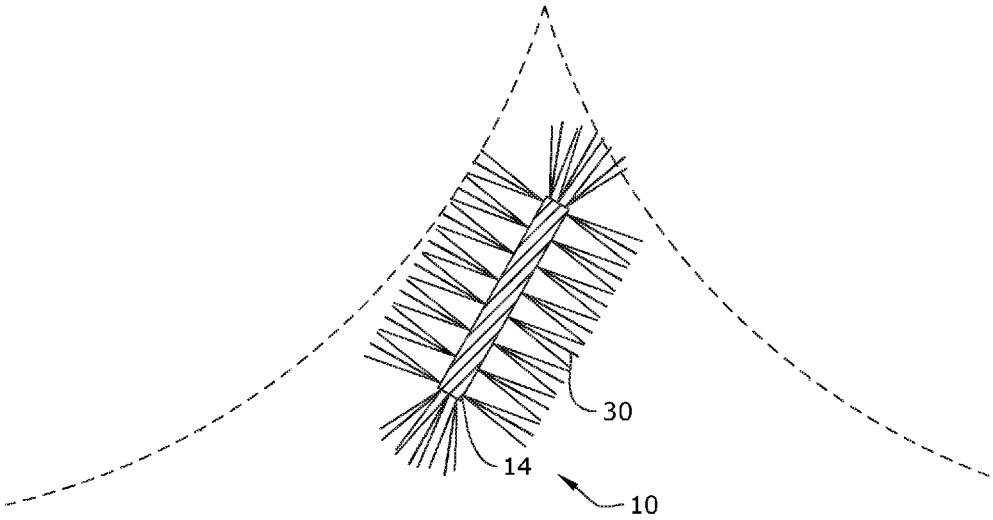
FIG. 4 is a section view of an embodiment of the present invention along line 4-4 in FIG. 3, shown in use.

Referring to FIGS. 1 through 4, the present invention includes a cleaning device 10. The cleaning device 10 includes a brush member 14 and a handle 12. The brush member 14 extends from the handle 10. The brush member 14 includes a first side, a second side opposite the first side, a first edge and a second edge opposite the first edge. A distance between the first edge and the second edge is substantially greater than a distance between the first side and the second side. Therefore, the brush member 14 may have a thin profile and resemble a blade. A plurality of bristles 30 extend from at least the first side, the second side and one of the first edge and the second edge of the brush member 14.

The brush member 14 may be used to clean in between the intergluteal cleft. The brush may be about 4 to about 6 inches long. In certain embodiments, the first side and the second side may be substantially flat. Further, the plurality of bristles 30 may extend from the first side, the second side, the first edge and the second edge. In certain embodiments, the brush member 14 may curve, which contours to the intergluteal cleft. In such embodiments, the first side edge and the second side edge may from the curve and may include a constant radius of curvature forming a bow shape. The first side edge and the second side curve with one another.

The handle 12 of the present invention is used to manipulate the brush member 14. The handle may be about 8 to 12 inches long. In certain embodiments, the handle 12 may also include a curve. The handle 12 may further include an opening 18 formed therethrough to fit a rope or lanyard within. The handle 12 may further include a finger bump 20 extending from a first side and a thumb indent 22 formed on an opposite side. The finger bump 20 and thumb indent 22 allows users to have a stronger grasp of the handle 12. This helps weak or handicap individuals. A notch 16 may also be formed at a rounded end of the handle 12. The notch 16 may hold a cotton ball or sanitary wipe to apply medication. The handle 12 may further include an anti-slip grip.

A method of using the present invention may include the following. Soap up the brush member, grip the handle and place the bush member in the area to be cleaned and gently stroke the center area within the intergluteal cleft. Rinse and hang up for reuse.

It should be understood, of course, that the foregoing relates to exemplary embodiments of the invention and that modifications may be made without departing from the spirit and scope of the invention as set forth in the following claims.

What is claimed is:

1. A cleaning device comprising:

a handle comprising an upper surface, a lower surface, and opposing sides;

a brush member extending from the handle and comprising a first side, a second side opposite the first side, a first edge and a second edge opposite the first edge, wherein a distance between the first edge and the second edge is substantially greater than a distance between the first side and the second side, wherein the first side and the second side of the brush member are perpendicular relative to the upper surface and the lower surface of the handle; and a plurality of bristles extending from at least the first side, the second side and the first edge, wherein at least the first edge of the brush member curves upward towards the upper surface of the handle.

2. The cleaning device of claim 1, wherein the handle is curved.

3. The cleaning device of claim 1, wherein the first edge and the second edge each form the curve.

4. The cleaning device of claim 1, wherein the handle further comprises a finger bump extending from the lower surface and a thumb indent formed on the upper surface.

5. The cleaning device of claim 1, further comprising an opening formed through the handle.

6. The cleaning device of claim 1, wherein the handle further comprises a notch formed at a rounded end.

7. The cleaning device of claim 1, wherein the plurality of bristles extend from the first edge and the second edge.

8. The cleaning device of claim 1, wherein the first side and the second side are substantially flat.

* * * * *